US009359892B2

(12) United States Patent
Tao

(10) Patent No.: US 9,359,892 B2
(45) Date of Patent: Jun. 7, 2016

(54) SPRING ASSISTED ACTIVE MUD CHECK VALVE WITH SPRING

(71) Applicant: Schlumberger Technology Corporation, Sugar Land, TX (US)

(72) Inventor: Chen Tao, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 524 days.

(21) Appl. No.: 13/803,065

(22) Filed: Mar. 14, 2013

(65) Prior Publication Data

US 2014/0158228 A1 Jun. 12, 2014

Related U.S. Application Data

(60) Provisional application No. 61/734,694, filed on Dec. 7, 2012.

(51) Int. Cl.
*E21B 34/10* (2006.01)
*E21B 49/08* (2006.01)

(52) U.S. Cl.
CPC ..... *E21B 49/081* (2013.01); *E21B 34/10* (2013.01); *Y10T 137/7838* (2015.04); *Y10T 137/86815* (2015.04)

(58) Field of Classification Search
CPC ..... Y10T 137/86815
See application file for complete search history.

(56) References Cited

U.S. PATENT DOCUMENTS 2,445,505 A * 7/1948 Ashton ..... 137/113
2,912,994 A * 11/1959 Mori ..... 137/98
3,158,167 A * 11/1964 Redelman et al. ..... 137/87.03
3,283,783 A * 11/1966 Kent ..... F15B 13/04 137/625.42
3,815,622 A * 6/1974 Allen ..... B60K 17/10 137/112
3,825,033 A * 7/1974 Hayner ..... F15B 13/0438 137/625.62
4,231,399 A * 11/1980 Pauliukonis ..... F16K 31/426 137/625.4
4,553,598 A 11/1985 Meek et al.
4,576,234 A 3/1986 Upchurch
4,860,581 A 8/1989 Zimmerman et al.
4,936,139 A 6/1990 Zimmerman et al.
7,527,070 B2 5/2009 Brennan, III et al.
7,577,070 B2 8/2009 Kawasaki et al.
2003/0131883 A1* 7/2003 Lorenz-Bornert ..... 137/98
2009/0249776 A1* 10/2009 Davidson ..... F15B 7/001 60/459
2009/0260798 A1 10/2009 Brennan, III et al.
2010/0032036 A1* 2/2010 Quendt et al. ..... 137/625.4
2010/0154896 A1* 6/2010 Thrash et al. ..... 137/112
2011/0114310 A1 5/2011 Ross et al.
2011/0214767 A1* 9/2011 Laing ..... 137/625.4

* cited by examiner

*Primary Examiner* — Giovanna C Wright
(74) *Attorney, Agent, or Firm* — Kenneth L. Kincaid

(57) ABSTRACT

An apparatus, a method and a system control fluid flow through a passageway. A downhole tool pumping apparatus may have a body and an active valve block. The body has a cavity housing a reciprocating piston defining first and second chambers within the cavity. The active valve block has active valves configured to be actively actuated between an open position and the closed position. Two or more hydraulic lines may be connected to each active valve for controlling actuating between the open position and the closed position. A piston having a conduit is slidably disposed through the passageway and selectively closes the conduit of the piston by moving at least one of the piston and a plug.

8 Claims, 9 Drawing Sheets

SPRING ASSISTED ACTIVE MUD CHECK VALVE WITH SPRING

CROSS-REFERENCE TO RELATED APPLICATIONS

This application claims priority to U.S. Provisional Application 61/734,694 filed Dec. 7, 2012, the entirety of which is incorporated herein by reference.

FIELD OF THE INVENTION

Aspects of the present disclosure generally relate to fluid flow control. More specifically, aspects of the present disclosure relate to controlling the flow of fluid such as formation fluid and/or borehole fluid within a downhole tool.

BACKGROUND INFORMATION

Underground formation testing is performed during drilling and geotechnical investigation of underground formations. The testing of such underground formations is important as the results of such examinations may determine, for example, if a driller proceeds with drilling and/or extraction. Since drilling operations are expensive on a per day basis, excessive drilling impacts the overall economic viability of drilling projects.

Multi-valve well testing tools use multiple valves configured in a circuit. Toggling of one of the valves typically sets the other valves into motion as well. The well testing tools disclosed in U.S. Pat. No. 4,553,598 to Meek entitled "Full Bore Sampler Valve Apparatus", and in U.S. Pat. No. 4,576,234 to Upchurch entitled "Full Bore Sampler Valve", are mechanical in nature. One valve is disposed in the tool and is mechanically linked to another valve disposed in the tool. To open one valve, an operator at the well surface, upon opening the valve, must expect the other valve to open or close, since the two valves are mechanically linked together. Therefore, the operation of one valve is not independent of the operation of the other valve. When one valve in the tool is opened, other valves disposed in the tool must be opened or closed in a specific predetermined sequence.

More recent multi-valve well testing tools use other arrangements for toggling valves. For example, semi-passive valves are referenced in U.S. Pat. No. 7,527,070 to Brennan, III et al., the entirety of which is incorporated herein by reference. Brennan, III et al. disclose valves that are partially passive wherein the flow of fluid through the valve assists in toggling the valve. Hydraulics are only used in the referenced system to assist in returning the valve-state to its original position. The hydraulic valve systems of the prior art do not use hydraulics to initially set the valve or valves into motion. Moreover, the valve systems are not fully active. That is, all aspects of valve movement are not controlled by hydraulics. To provide a valve system that is fully active, a solenoid is required for each individual valve. Space is limited in a downhole tool, and each solenoid requires a relatively large amount of space.

Therefore, a need exists for providing a system and/or method that uses hydraulic pressure to toggle valve state while minimizing size and/or the number of solenoids required.

DETAILED DESCRIPTION

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity and/or conciseness.

The example valves described herein may be used on a downhole tool to sample fluids in a subterranean formation. More specifically, the example valves described herein may route dirty fluid between the displacement unit and inlet or outlet flowline portions of a testing tool.

Figure 1:
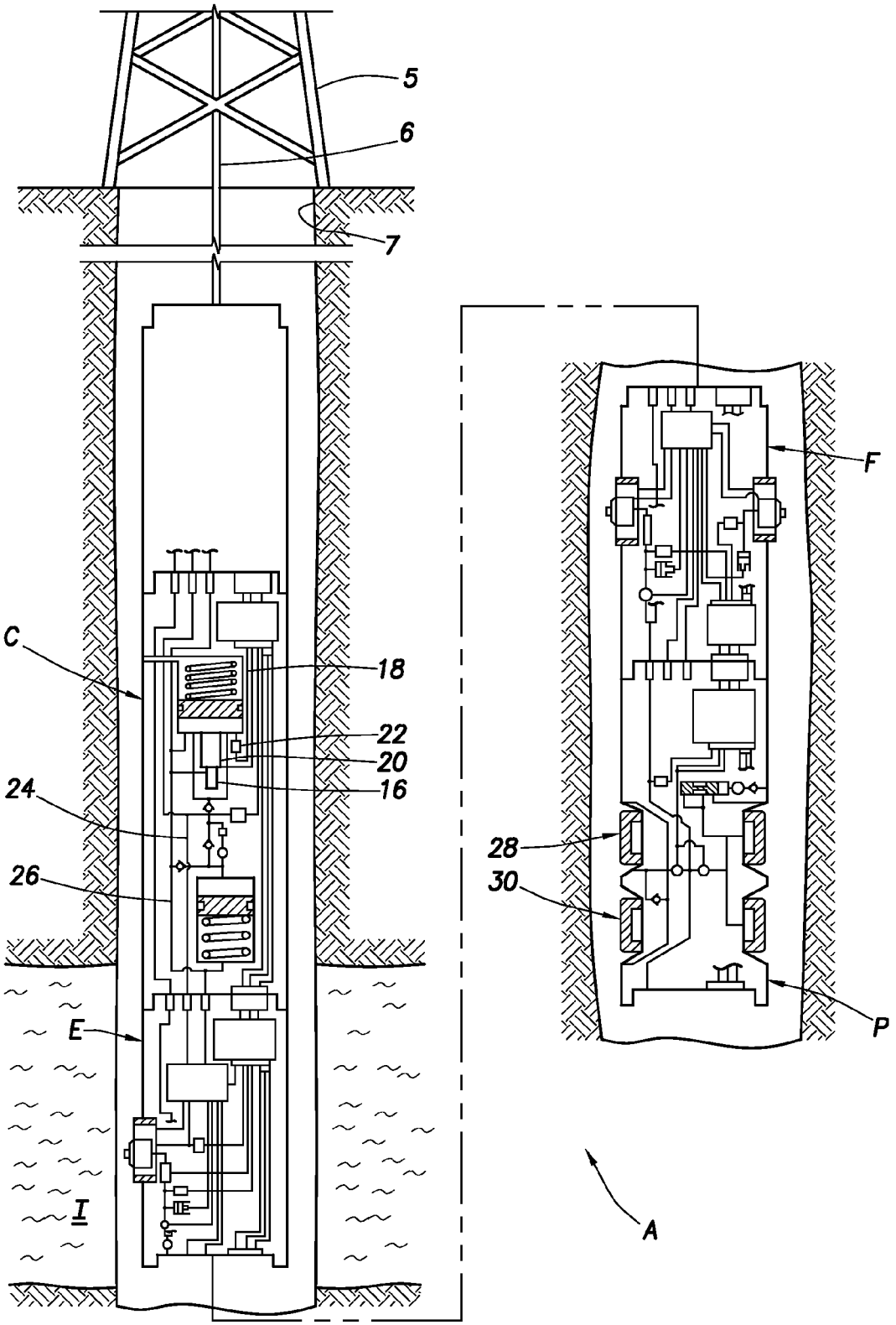
FIG. 1 (PRIOR ART)
FIGS. 1 and 2 are schematic views of a prior art wireline-conveyed downhole tool with which one or more aspects of the present disclosure may be used.
Figure 2:
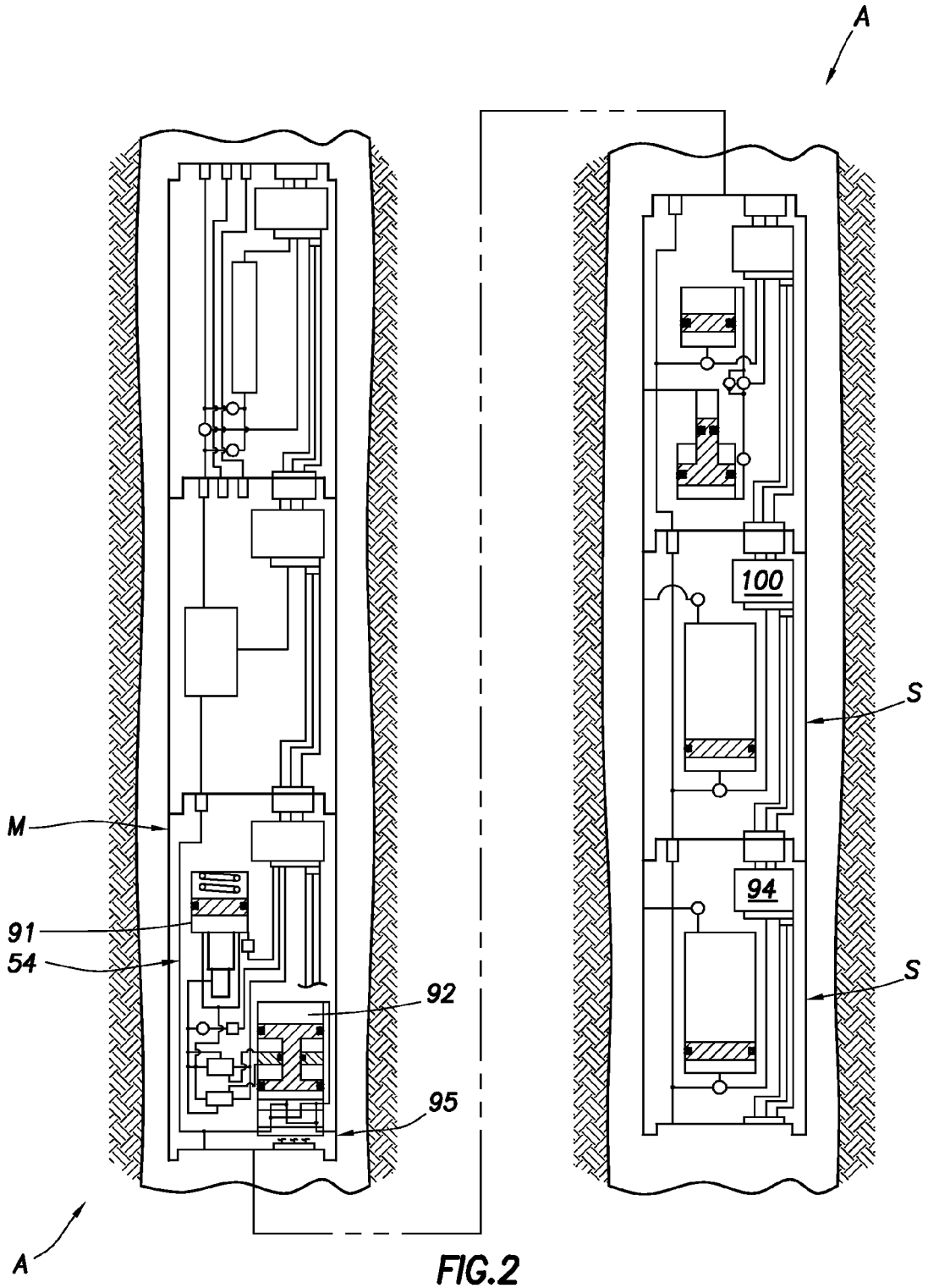
FIG.2 (PRIOR ART)

FIGS. 1 and 2 illustrate a prior art downhole tool which may be suspended from a rig 5 by a wireline 6 and lowered into a well bore 7 for the purpose of evaluating surrounding formations I. Details relating to tool A are described in U.S. Pat. Nos. 4,860,581 and 4,936,139, both to Zimmerman et al., the entireties of which are hereby incorporated by reference. The downhole tool A has a hydraulic power module C, a packer module P, and a probe module E. The hydraulic power module C includes a pump 16, a reservoir 18, and a motor 20 which controls operation of the pump 16. A low oil switch 22 also forms part of the control system and is used to regulate the operation of the pump 16.

The hydraulic fluid line 24 is connected to the discharge of the pump 16 and runs through hydraulic power module C and into adjacent modules for use as a hydraulic power source. In the embodiment shown in FIG. 1, the hydraulic fluid line 24 extends through the hydraulic power module C into the probe modules E and/or F depending upon which configuration is used. The hydraulic loop is closed by virtue of the hydraulic fluid return line 26. As shown in FIG. 1, the hydraulic fluid return line 26 extends from the probe module E to the hydraulic power module C where the hydraulic fluid return line 26 terminates at the reservoir 18.

The tool A further includes a pump-out module M, as shown in FIG. 2, which can be used to dispose of unwanted samples by pumping fluid through the flow line 54 into the borehole, or may be used to pump fluids from the borehole into the flow line 54 to inflate the straddle packers 28 and 30, as shown in FIG. 1. Furthermore, the pump-out module M may be used to draw formation fluid from the borehole via the probe module E or F, and then pump the formation fluid into the sample chamber module S against a buffer fluid therein. In other words, the pump-out module may be used for pumping fluids into, out of, and through the downhole tool A.

A piston pump 92, energized by hydraulic fluid from a pump 91, may be aligned in various configurations, e.g., to draw from the flowline 54 and dispose of the unwanted sample though flowline 95. Alternatively, the pump 92 may be aligned to pump fluid from the borehole into the flowline 54. The pump-out module M can also be configured where the flowline 95 connects to the flowline 54 such that fluid may be drawn from the downstream portion of the flowline 54 and pumped upstream or vice versa. The pump-out module M has the necessary control devices to regulate the piston pump 92 and to align the fluid line 54 with the fluid line 95 to accomplish the pump-out procedure.

Referring to FIGS. 3A, 3B, 4A and 4B, a particular embodiment of the pump-out module M may use four reversible mud check valves 390, also referred to as CMV1-CMV4, to direct the flow of the fluid being pumped. These reversible mud check valves 390 allow the pump-out module M to pump either up or down, or in or out, depending on the tool configuration. The reversible mud check valves 390 may utilize a spring-loaded ceramic ball 391 that seals alternately on one of two O-ring seats 393*a*, 393*b* to allow fluid flow in only one direction. The O-ring seats 393*a*, 393*b* are mounted in a sliding piston-cylinder 394, also called a check valve slide or a piston slide.

Figure 3A:
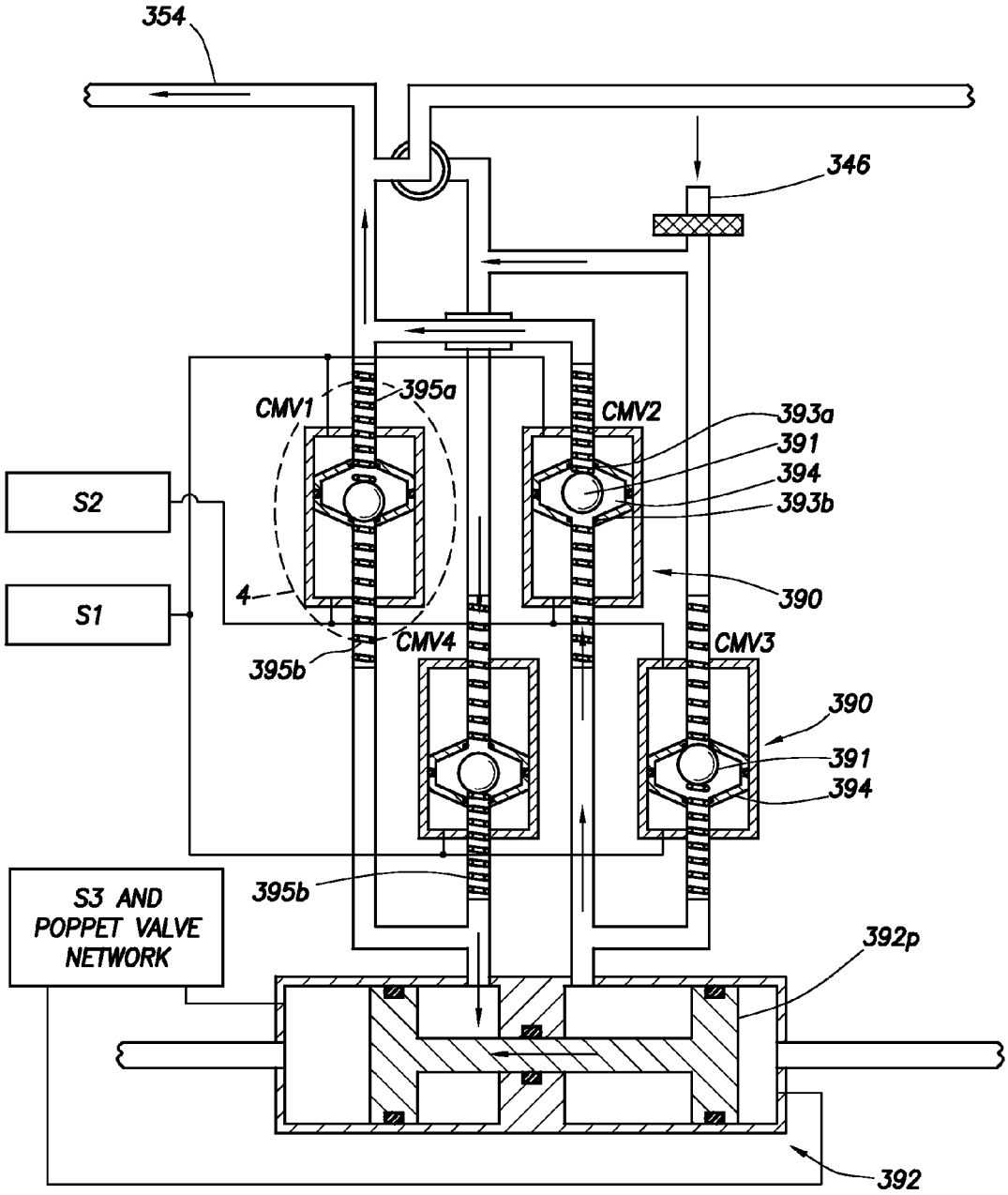
FIG.3A (PRIOR ART)
FIGS. 3A, 3B, 4A and 4B are schematic views of a prior art fluid pumping system.
Figure 3B:
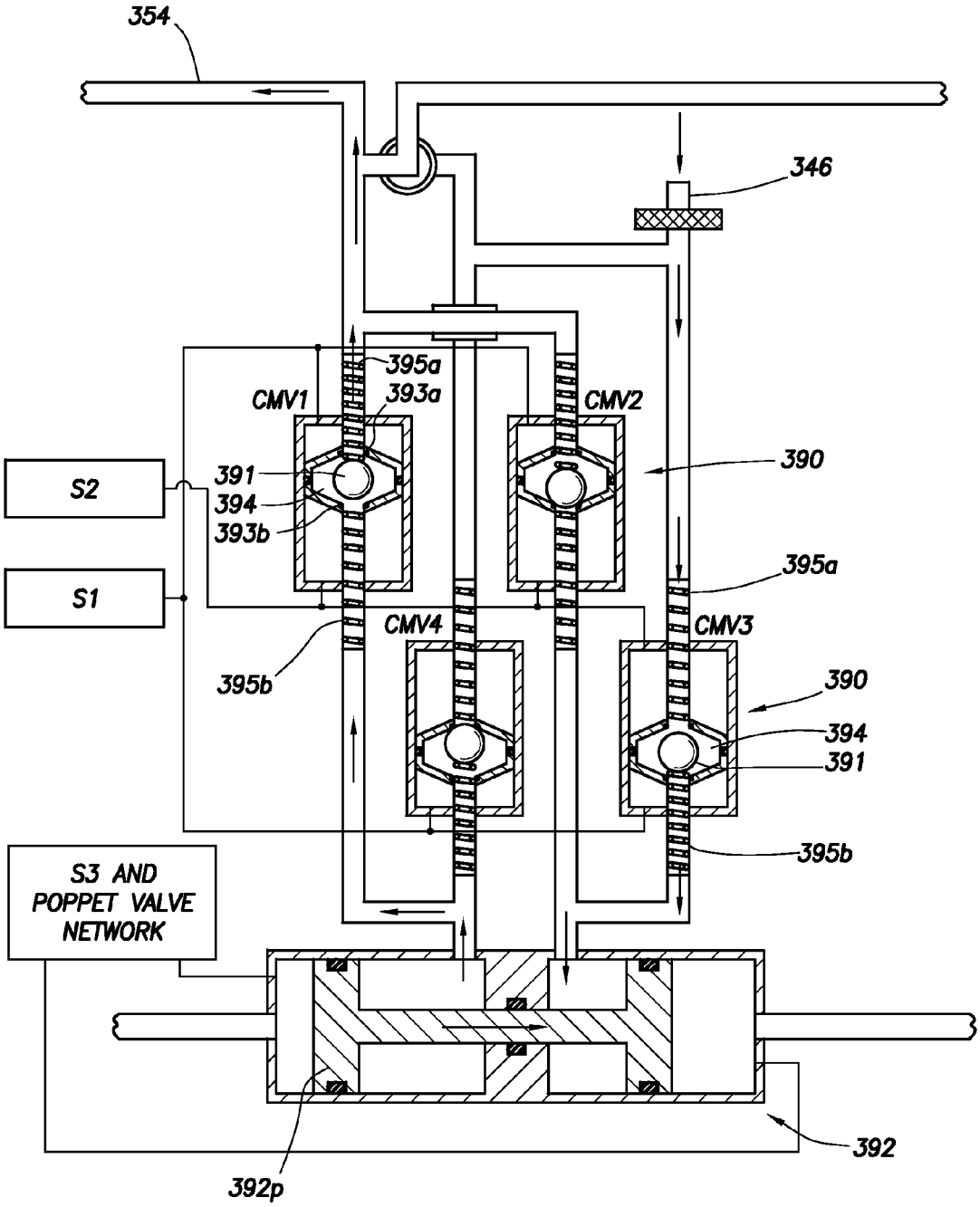
FIG.3B (PRIOR ART)

FIGS. 3A and 3B show the respective first stroke and second stroke of the two-stroke operation of the piston pump 392 with the pump-out module M configured to "pump-in" mode, where fluid is drawn into the module M through a port 346 for communication via a flowline 354. Thus, the solenoids SI, S2 are energized in FIGS. 3A and 3B to direct hydraulic fluid pressure to shift the piston slides 394 of the check valves CMV1 and CMV2 upwardly and shift the piston slides 394 of the check valves CMV3 and CMV4 downwardly. The fluid pressure causes the upper springs 395*a* of the check valves CMV1 and CMV2 to bias the respective balls 391 against the lower seal seats 393*b*, and the lower springs 395*b* of check valves CMV3 and CMV4 to bias the respective balls 391 against the upper seal seats 393*a*. The biasing of the balls 391 allows fluid to flow upwardly through the check valve CMV2 and downwardly through the check valve CMV4 under movement of the piston 392*p* to the left, as indicated by the directional arrows of FIG. 3A. Similarly, the biasing of the balls 391 allows fluid to flow upwardly through the check valve CMV1 and downwardly through valve CMV3 under movement of the piston 392*p* to the right, as indicated by the directional arrows of FIG. 3B. Sufficient fluid-flowing pressure may be needed to overcome the respective spring-biasing forces. Solenoid S3 is provided to selectively move the pump piston 392*p* from the position in FIG. 3A to the position in FIG. 3B and back. The solenoid S3 may also be linked to solenoids S1 and S2 to synchronize the timing therebetween.

Figure 4A:
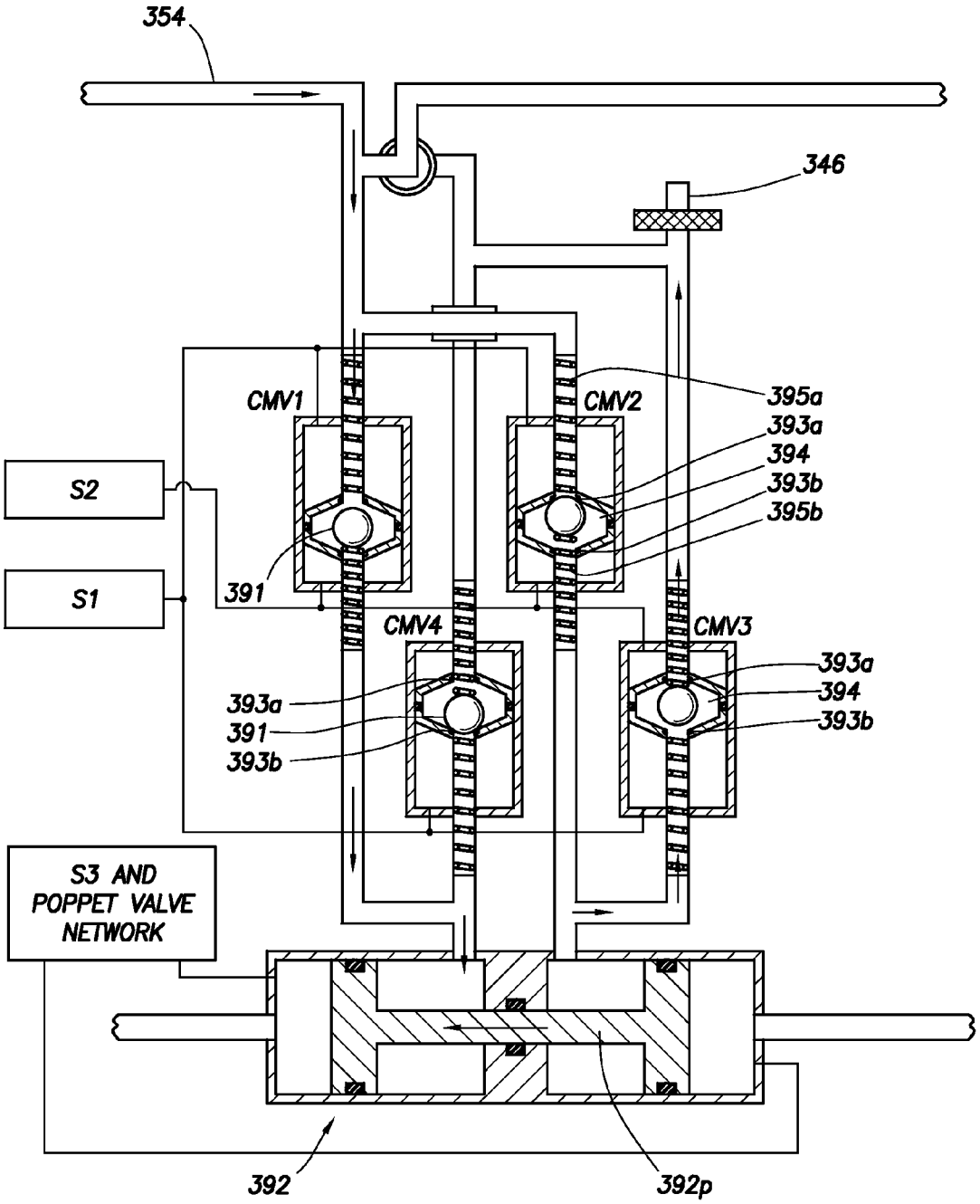
FIG.4A (PRIOR ART)
Figure 4B:
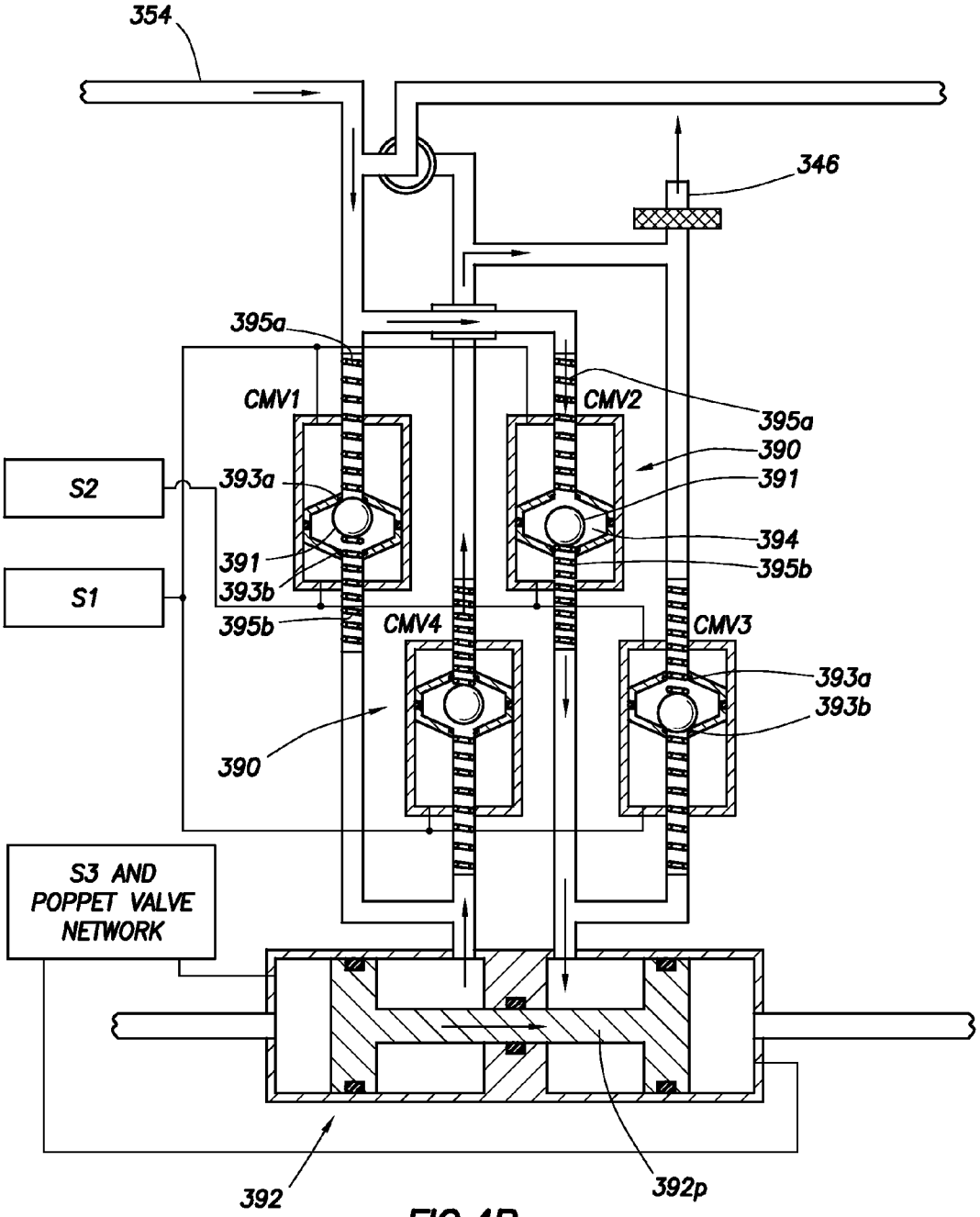
FIG.4B (PRIOR ART)

FIGS. 4A and 4B show a respective first stroke and second stroke of the two-stroke operation of the piston pump 392 with the pump-out module M configured to "pump-out" mode, where fluid is discharged from the flowline 354 through the port 346 into the borehole. Thus, the solenoids S1, S2 have been de-energized in FIGS. 4A and 4B to direct hydraulic pressure to shift the piston slides 394 of the check valves CMV1 and CMV2 downwardly and shift the piston slides 394 of the check valves CMV3 and CMV4 upwardly. This shifting results in the lower springs 395*b* of the check valves CMV1 and CMV2 biasing the respective balls 391 against the upper seal seats 393*a*. Further, the shifting results in the upper springs 395*a* of the check valves CMV3 and CMV4 biasing the respective balls 391 against the lower seal seats 393*b*. The biasing of the balls 391 allows fluid to flow downwardly through the check valve CMV1 and upwardly through the check valve CMV3 under movement of the pump piston 392*p* to the left, as indicated by the directional arrows of FIG. 4A. Similarly, the biasing of the balls 391 allows fluid to flow downwardly through the check valve CMV2 and upwardly through the check valve CMV4 under movement of the pump piston 392*p* to the right, as indicated by the directional arrows of FIG. 4B. Sufficient fluid-flowing pressure may be needed to overcome the respective spring-biasing forces.

In each of the FIGS. 3A, 3B, 4A and 4B, the check valves having no directional flow arrows are configured such that their respective balls 391 are subjected to fluid pressure that compresses each ball against an o-ring seat to maintain a seal. Conversely, when the direction of fluid flow opposes the spring-biasing forces, a gap is opened between the ball and the seat so as to permit the fluid flow indicated by the three directional arrows. The valves open to balance the pressure differential across the opening with the biasing forces provided by the respective springs.

The fluid pumped through the tool A, flows directly past the o-ring seats 393*a*, 393*b* at various intervals during the two-stroke pumping cycles. Since this fluid may be formation fluid or borehole fluid laden with impurities varying from fine mud particles to abrasive debris of various sorts, such flow may produce accelerated wear of the o-ring seats. The wear can shorten the life of the o-ring and may lead to frequent failure of the seals. The following are examples of failures that may occur: 1) the o-ring is gradually worn during the pumping process until the o-ring will no longer seal; 2) debris gets trapped between the ball and one or both of the O-ring seats; 3) fine particles settle in the valve cavity and may gradually build up to the point where the particles prevent the ball from sealing against the seat; and 4) filters that are typically used with such valves are susceptible to plugging. The failure of any one of the four reversible mud check valve seals may reduce the output of the pump 392, and the loss of two seals may completely disable the pump 392.

The present disclosure illustrates a system and method for pumping formation fluid through a downhole tool using controlled mud check valves. The system and/or method may use one or more springs to assist in opening and closing the valves. The mud check valves may operate using only hydraulic pressure with the assistance of the springs. Furthermore, a reduced number of solenoids are required to open and close the valves.

Figure 5A:
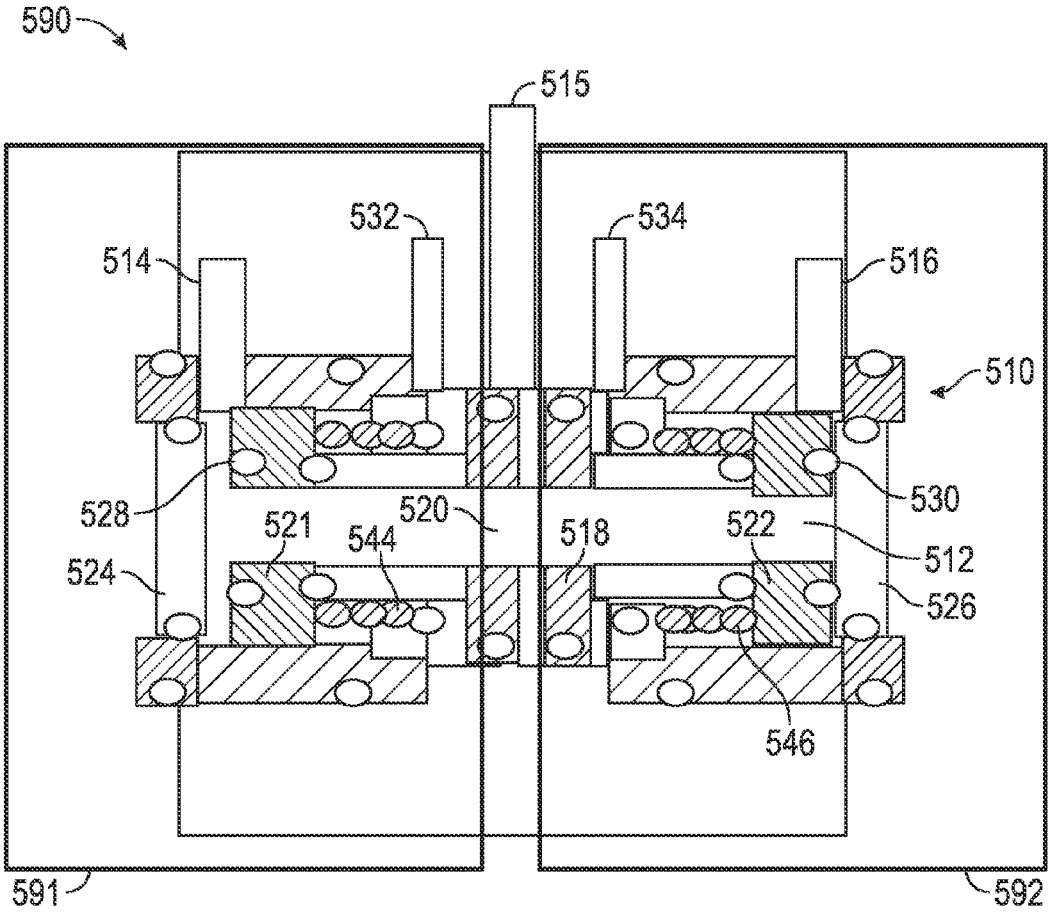
FIGS. 5A and 5B show an active mud check valve with two hydraulic lines in accordance with one or more aspects of the present disclosure.
Figure 5B:
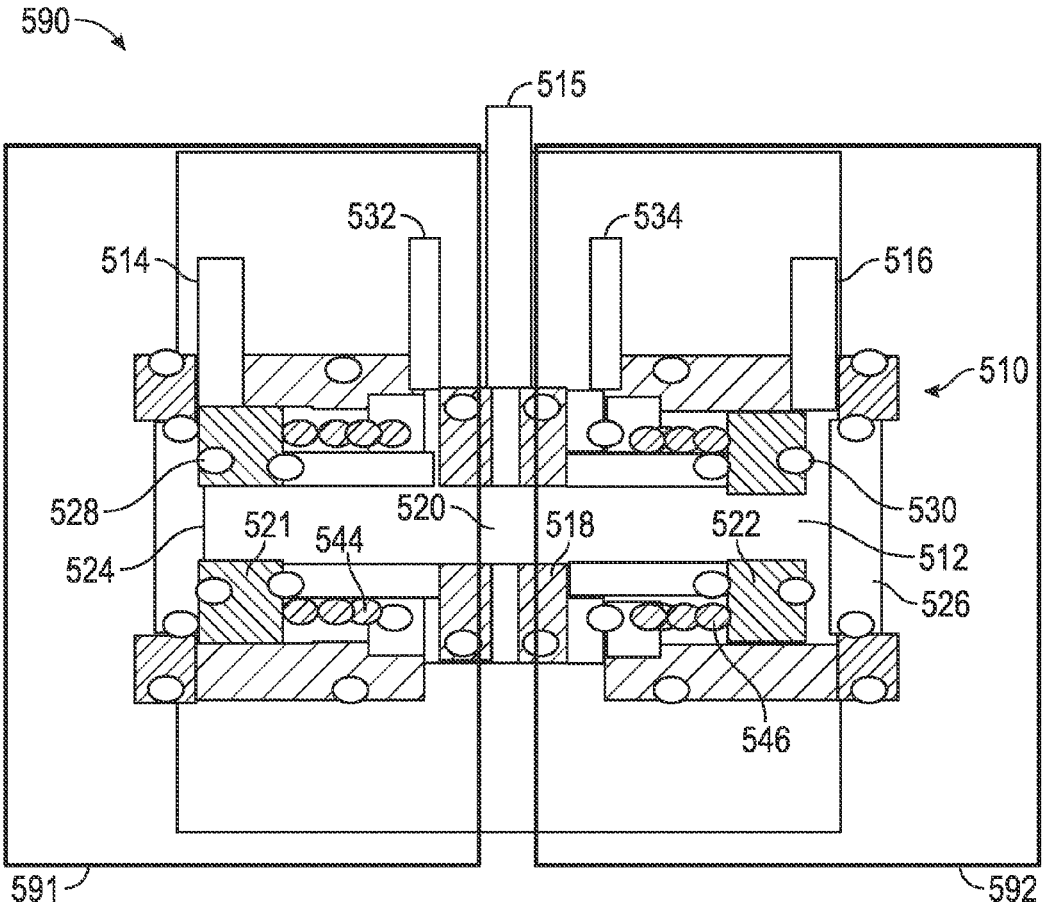

In accordance with the present disclosure, a valve 590 is described to exhibit a non-limiting example of an embodiment of the application. Referring now to the drawings wherein like numerals refer to like parts, FIGS. 5A and 5B show schematic views of a flow control valve 590 in respective closed and open positions according to one or more aspects of the present disclosure.

The valve 590 combines two mud check valves 591, 592 in one port, thus saving tool space and reducing flowline dead volume. The valve 590 may be used as a check valve, e.g., as a replacement for the check valve CMV1 (also referenced as 390) of FIGS. 3A, 3B, 4A and 4B within a downhole tool, such as tool A of FIGS. 1 and 2. The downhole tool is adapted for use in a borehole environment. Accordingly, the check valve 590 includes a body 510 having a fluid passageway 512 therethrough and a first flowline 514 and a second flowline 516. Each of the flowlines 514, 516 is adapted for receiving or discharging fluid from the passageway 512. The first flowline 514 may communicate fluid with another portion of the tool, such as, for example, a lower module of the tool. The second flowline 516 may communicate fluid with another portion of the tool, such as, for example, an upper module of the tool. A third flowline 515 may be provided extending from the valve 590. The third flowline 515 may be in communication with a displacement unit, such as the displacement unit 392 shown in FIGS. 3A, 3B, 4A and 4B.

A piston 518 may be slidably disposed in the passageway 512 between the first flowline 514 and the second flowline 516 of the body 510. The piston 518 may have a conduit portion 520 that defines a bore therethrough for conducting fluid through the passageway 512. The piston 518 may have the third flowline 515 extending therefrom. The piston 518 may also be referred to as a sliding cylinder, a check valve slide, or simply a piston slide.

A pair of annular seals 528, 530 may seal the first flowline 514 and the second flowline 516, respectively. The annular seals 528, 530 may be elastomeric o-rings, or various other materials, as dictated by the operating temperatures and pressures in the downhole environment. The annular seals 528, 530 may have a metal cone sealable against a donut elastomer. Furthermore, the annular seals 528, 530 may be face seals or shear seals. The annular seals 528, 530 are adapted for sealably engaging inner walls 524, 526 upon translatory movement of the piston 618 relative to the body 510. FIG. 5A shows the annular seal 530 engaging the inner wall 524 to close the first flowline 514. Outer flanged portion 521, 522 are affixed at the ends of the piston 518 for abutting the inner walls 524, 526.

The valve body 510 may also have a first hydraulic line 532 and a second hydraulic line 534 extending therefrom. The hydraulic lines 532, 534 may be in communication with the directional unit, a pump, and/or any other device for creating differential pressure. Accordingly, differential pressure across the hydraulic lines 532, 534 such as that provided by pressurized hydraulic fluid in a known manner, induces reciprocal translatory movement of the piston 518 within the passageway 512 of the body 510. FIG. 5A shows the valve system with the first flowline 514 in an open position, and the second flowline 516 in a closed position. Thus, in the position shown in FIG. 5A, the first hydraulic line 532 has a higher pressure than the second hydraulic line 534, resulting in the piston 518 being pressed against the first inner wall 524. Thus, the position of the piston 518 may be controlled by the hydraulic lines 532, 534 by increasing and decreasing the pressure within the lines. Thus, the valve 590 does not rely on pressure from formation fluid and/or the displacement unit to be toggled.

The valve 590 may further include a pair of coil springs 544, 546 slidably disposed at least partially around a portion of the piston 518. The coil springs 544, 546 yieldably limit translatory movement of the piston 512 within the passageway 512. Thus, increasing the pressure of the first hydraulic line 532 above that of the second hydraulic line 534 induces translatory movement of the piston 518 within the passageway 512 of the body 510 to one of two stop positions. In the stop position of FIG. 5A, the outer flanged portion 522 of the piston 518 abuts a portion of the inner wall 526 of the valve body 510. One having ordinary skill in the art will appreciate that, due to the spring loading on the piston 518, the piston 518 may be positioned in the "no flow" condition. In "no flow" condition one of the annular seals 528, 530 engage the inner walls 514, 516 to close both the first flowline 514 and the second flowline 516.

From the position of FIG. 5A, the inner wall 526 constrains movement towards the coil spring 546. Such movement occurs when the piston 518 is energized by the pressure of fluid provided to the hydraulic line 532. The fluid pressure is increased on the first side 591 of the valve 590 until sufficient force is developed to overcome the bias of the coil spring 546. In other words, the hydraulic pressure may move the plug 526 from the position of FIG. 5A to the position of FIG. 5B by compressing the coil spring 544 so that the coil spring 544 yields to such movement. The inner walls 524, 526 may act as hard limits on the range of translatory movement by the piston 518, and thus limit the range of yielding by the coil springs 544, 546. It will, therefore, be appreciated by one having ordinary skill in the art that a function of the coil springs 544, 546 is to bias the piston 518 towards a position where one of the annular seals 528, 530 engages the inner walls 524, 526. When the annular seals 528, 530 engage the inner walls 524, 526 the flowlines 514, 516 close and prevent fluid flow through the valve passageway 512.

Figure 6:
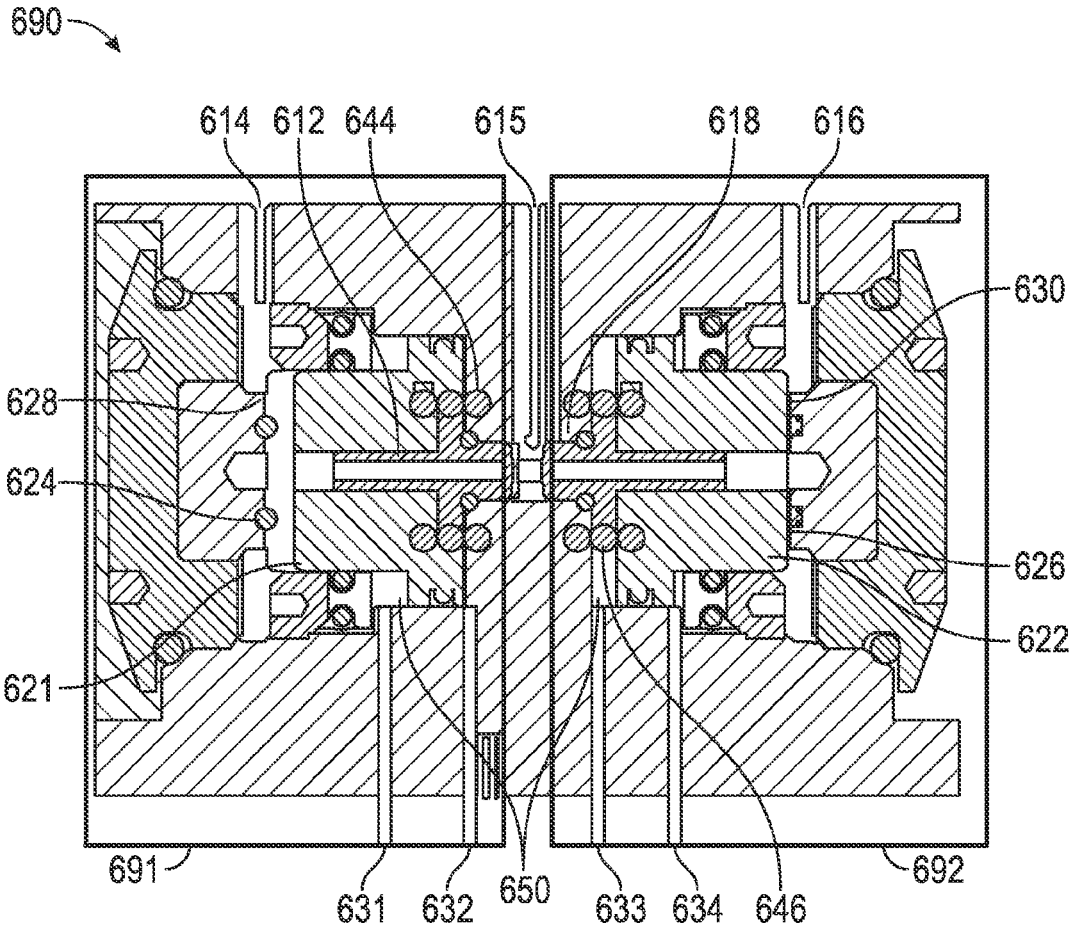
FIG. 6 shows an active mud check valve with four hydraulic lines in accordance with one or more aspects of the present disclosure.

FIG. 6 shows an embodiment of an active valve 690 with four hydraulic lines. As illustrated, this embodiment has four hydraulic lines 631, 632, 633, and 634 on each side 691, 692 of the piston 618. Fluid may enter or exit the valve 690 through a first flowline 614 and/or a second flowline 616. Fluid may also be communicated to a displacement unit via a third flowline 615. Fluid may travel through a passageway 612 bored inside of the piston. Thus, fluid entering through the first flowline 614 may flow past a first inner wall 624 and the first end of the piston 618 into the passageway 612 of the piston 618. From there, the fluid may exit the valve 690 through the third flowline 615.

Movement of the piston 618 may be dictated by the increasing and/or decreasing of pressure in the hydraulic lines 631, 633. For example, hydraulic pressure may be increased in the hydraulic lines 631, 633 to bias the piston towards an inner wall 626 to seal a second flowline 616. A vacuum cavity 650 may be defined between the piston 618 and a body 610 of the valve 690. The hydraulic lines 631, 632, 633, 634 may be fluidly connected to the cavity 650 such that an increase and/or a decrease of pressure via the hydraulic lines 631, 632, 633, 634 causes the piston 621 to move within the cavity 650.

Elastomer donuts 628, 630 may be provided on the inner walls 624, 626 to engage end portions 621, 622 of the piston 618. Alternatively, a cone-shaped opening in the end portions 621, 622 may engage a cone-shaped elastomer (not shown) extending from the inner walls 624, 626 of the valve 690.

Coil springs 644, 646 may be provided within the valve 690 to aid in biasing the piston 618. The coil springs 644, 646 may act to move the piston 618 to an original position after the piston 618 has been moved to one side or another due to hydraulic pressure.

The preceding description has been presented with reference to present embodiments. Persons skilled in the art and technology to which this disclosure pertains will appreciate that alterations and changes in the described structures and methods of operation can be practiced without meaningfully departing from the principle and scope of the disclosure. Accordingly, the foregoing description should not be read as pertaining only to the precise structures described and shown in the accompanying drawings, but rather should be read as consistent with and as support for the following claims, which are to have their fullest and fairest scope.

In one example embodiment, a valve is disclosed comprising: a body defining a volume; at least two mud check valves in the body, a fluid passageway connecting the at least two mud check valves, a first flowline configured to transport a first portion of a fluid, a second flowline configured to transport a second portion of the fluid, wherein each of the first and second flowlines are configured to receive and discharge fluid from the passageway wherein the first flowline is configured to transfer the first portion of the fluid to a first portion of a downhole tool and wherein the second flowline is configured to transfer the second portion of the fluid to a second portion of the downhole tool.

In another example embodiment a valve for transporting a fluid, comprising: a body, a flowline, at least four hydraulic lines in the body, the hydraulic lines configured to transport the fluid, and a piston configured to move according to at least one of an increasing and decreasing pressure in two of the hydraulic lines, wherein the piston is configured to transport to a position to allow the fluid to exit the valve via the flowline.

Although exemplary systems and methods are described in language specific to structural features and/or methodological acts, the subject matter defined in the appended claims is not necessarily limited to the specific features or acts described. Rather, the specific features and acts are disclosed as exemplary forms of implementing the claimed systems, methods, and structures.

What is claimed is:

1. A valve, comprising:

a body defining a volume;

at least two mud check valves in the body;

a fluid passageway connecting the at least two mud check valves;

a piston slidably disposed in the fluid passageway, wherein the piston is configured with a conduit portion comprising a bore therethrough the piston for conducting the fluid through the fluid passageway;

a first flowline configured to transport a first portion of a fluid;

a second flowline configured to transport a second portion of the fluid, wherein each of the first and second flowlines are configured to receive and discharge fluid from the passageway wherein the first flowline is configured to transfer the first portion of the fluid to a first portion of a downhole tool and wherein the second flowline is configured to transfer the second portion of the fluid to a second portion of the downhole tool;

a third flowline extending from the piston, wherein the piston comprises a passageway fluidly coupling the conduit portion of the piston and the third flowline;

a first hydraulic line configured to transport a hydraulic fluid; and a second hydraulic line configured to transport the hydraulic fluid.

2. The valve according to claim 1, wherein the third flowline is configured to transfer fluid from a displacement unit to the valve.

3. The valve according to claim 1, wherein the piston is configured between the first flowline and the second flowline.

4. The valve according to claim 1, further comprising:

a pair of annular seals configured in the first flowline and the second flowline.

5. The valve according to claim 1, further comprising:

a pair of coil springs slidably disposed at least partially around a portion of the piston.

6. The valve according to claim 1, wherein the valve is configured for conveyance within a wellbore by at least one of a wireline or a drillstring.

7. A valve for transporting a fluid, comprising:

a body;

a first flowline configured to transport a first portion of a fluid;

a second flowline configured to transport a second portion of the fluid;

a third flowline;

at least four hydraulic lines in the body, the hydraulic lines configured to transport a hydraulic fluid;

a piston configured to move according to at least one of an increasing and decreasing pressure in two of the hydraulic lines, wherein the piston is configured to transport to a position to allow at least one of the first portion of the fluid to exit the valve via the first flowline or the second portion of the fluid to exit the valve via the second flowline, the piston is slidably disposed in a fluid passageway of the valve, the piston is configured with a conduit portion comprising a bore therethrough the piston for conducting the fluid through the fluid passageway, the third flowline extends from the piston, and the piston comprises a passageway fluidly coupling the conduit portion of the piston and the third flowline.

8. The valve according to claim 7, wherein the valve is configured for conveyance within a wellbore by at least one of a wireline or a drillstring.

* * * * *